US005655658A

United States Patent [19]

Saveliev et al.

[11] Patent Number: 5,655,658

[45] Date of Patent: Aug. 12, 1997

[54] CASSETTE CONTAINER HAVING EFFECTIVE CENTERING CAPABILITY

[75] Inventors: Alex Saveliev; Victoria Lynn Decker; Michael William Didas, all of Rochester, N.Y.

[73] Assignee: Eastman Kodak Company, Rochester, N.Y.

[21] Appl. No.: 455,006

[22] Filed: May 31, 1995

[51] Int. Cl.[6] ..... B65D 85/00; B65D 90/12

[52] U.S. Cl. ..... 206/407; 206/316.1; 220/23.4; 220/23.83; 220/631; 220/636

[58] Field of Search ..... 206/316.1, 389, 206/407; 220/608, 628, 631, 23.2, 23.4, 23.83, 737, 606, 635, 636; 215/326

[56] References Cited

U.S. PATENT DOCUMENTS

| | | | |
|---|---|---|---|
| 3,169,629 | 2/1965 | Randrup . | |
| 3,526,334 | 9/1970 | Ashton et al. | 220/23.83 |
| 3,815,281 | 6/1974 | Kander | 220/23.4 X |
| 4,280,612 | 7/1981 | Nagano . | |
| 4,529,469 | 7/1985 | Jorss . | |
| 4,711,687 | 12/1987 | Paules . | |
| 4,801,011 | 1/1989 | Desdoigts et al. | 206/316.1 |
| 4,844,961 | 7/1989 | Akao | 206/407 X |
| 4,921,737 | 5/1990 | Akao | 206/316.1 X |
| 4,960,626 | 10/1990 | Akao et al. | 206/316.1 X |
| 5,106,665 | 4/1992 | Akao et al. | 206/407 X |
| 5,201,984 | 4/1993 | Bedin . | |
| 5,225,259 | 7/1993 | Akao | 206/316.1 X |
| 5,240,754 | 8/1993 | Akao et al. | 206/389 X |

*Primary Examiner*—Bryon P. Gehman

*Attorney, Agent, or Firm*—Peter J. Bilinski; Robert Luke Walker

[57] ABSTRACT

A cylindrical container for containing a film cassette includes a bottom surface having a pair of radially extending rib members for engaging with a centering apparatus. According to the invention, the radially extending members are diametrically opposed to one another to reduce axial misalignment of the container when it is being centered on the centering apparatus. The centering apparatus includes a pair of restricting elements which engage the rib members when the container is mounted to the apparatus and which more accurately locate the container to a predetermined radial location due to the engagement of each restricting element with each of the rib members.

9 Claims, 6 Drawing Sheets

CASSETTE CONTAINER HAVING EFFECTIVE CENTERING CAPABILITY

CROSS-REFERENCE TO RELATED APPLICATION(S)

Reference is made to commonly assigned copending application Ser. No. 08/455,957, entitled: FILM CANISTER filed concurrently herewith in the names of Victoria L. Decker, Michael W. Didas, and William G. Hoyt, and which is assigned to the assignee of this application.

FIELD OF THE INVENTION

The invention relates generally to the field of photography. In particular, the invention relates to an improved container for a photographic film cartridge which allows proper centering, such as for labeling of the container.

BACKGROUND OF THE INVENTION

Containers for photographic film cartridges or cassettes are generally known in the field. Typically, a cylindrical receptacle having an open end includes a snap-type or plug-type cover, or lid, which snaps or is plugged onto the open end of the receptacle to retain the cartridge and seal the retained cartridge from dust, light and moisture.

Labeling of the container is often desirable to identify the contents of the container. Most preferably, such labeling done by a high speed automated process. In order to provide effective labeling, however, the container should be specifically oriented.

In containers such as described above, a cutout portion provided on the bottom surface of the container assists in keeping the container in an upright position, and is used in conjunction with a centering fixture. A single radial drive rib member within the cutout portion is engaged and registered with the centering fixture after a container is mounted thereto in order to provide the specific orientation required for labeling, or other manufacturing processes requiring a datum. Manufacturing tolerances, however, between the dimensions of the cutout portion and the centering fixture, as well as between the single rib member and the centering fixture can prevent effective centering of the container in that it is more difficult to specifically and repeatably orient the container, in which poor labeling can be a result.

SUMMARY OF THE INVENTION

The present invention is directed to overcoming one or more of the problems set forth above. Briefly summarized, according to one aspect of the present invention, there is provided a cylindrical container for containing a film cassette comprising a body including a bottom surface and a center axis, is characterized in that:

the bottom surface includes at least two centering members, said centering members being diametrically opposed to one another relative to said center axis.

According to another aspect of the present invention there is provided a method of centering a container having a bottom surface having at least two diametrically opposed elements radially extending relative to a center axis, comprising the steps of:

positioning the bottom of the container onto the centering apparatus; and rotating the container about the center axis until one of said diametrically opposed elements contacts a first stop surface of said centering apparatus to provide a registration point and said other diametrically opposed element contacts a second stop surface of said centering apparatus to restrict nonaxial alignment of said container.

According to yet another aspect of the present invention, there is provided a centering combination comprising a cylindrical container having a bottom surface having at least two centering members which are diametrically opposed to one another relative to a centering axis, and a centering device having a base for engaging the bottom surface of said container, said base having a pair of substantially diametrically opposed stop elements for engaging each of said diametrically opposed centering members when said container is engaged with said container.

An advantageous aspect of the present invention is that a container using a multiple drive rib design, as described by the present invention, can be more accurately and repeatably centered and provide a more reliable starting point which can be used as a registration datum for processes, such as for applying a label to the container.

Another advantageous aspect of the present invention is that a smaller "target zone" is then required in order to print an expiration date onto the label. This advantage is important so that the printed material does not run into other preprinted material on the label.

Still another advantageous aspect of the present invention is that an improved centering of the container also enhances other processes, such as capping and cap labeling operations.

These and other aspects, objects, features and advantages of the present invention will be more clearly understood and appreciated from a review of the following Detailed Description of the Preferred Embodiments and appended Claims, and by reference to the accompanying Drawings.

BRIEF DESCRIPTION OF THE DRAWINGS

FIG. 1(*c*) is an enlarged view of the single drive rib of the prior art container of FIGS. 1(*a*) and 1(*b*);

DETAILED DESCRIPTION OF THE INVENTION

Figure 1C:
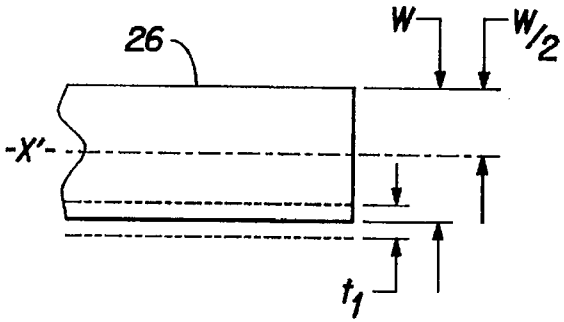
FIGS. 1(*a*) and 1(*b*) are partial side and bottom views, respectively, of a film canister having centering features according to the prior art.
Figure 1A:
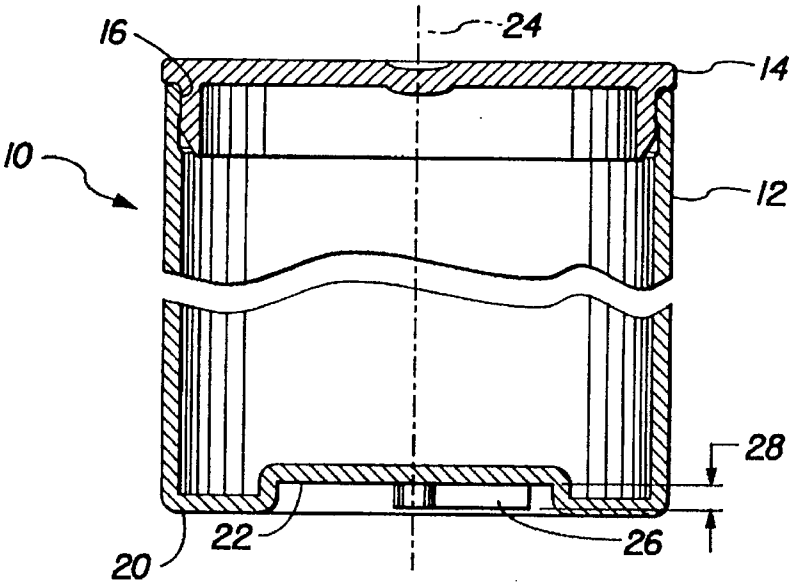
Figure 1B:
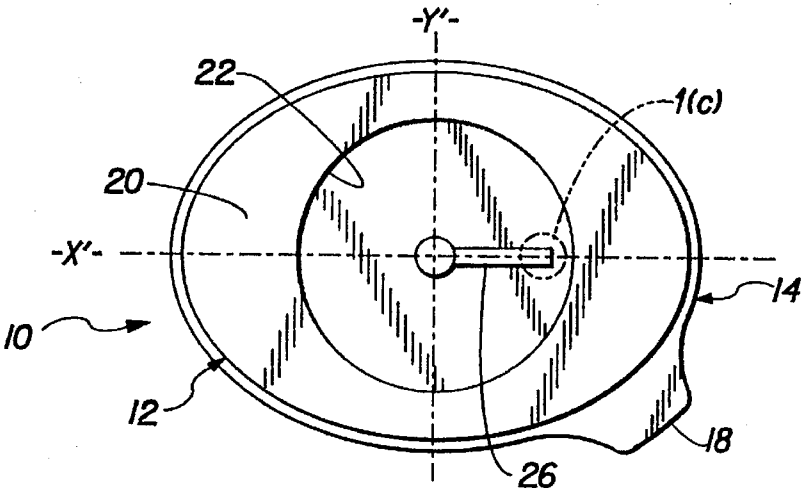

Beginning with FIGS. 1(*a*) and 1(*b*), there is shown a known container 10 for storing a photographic film cassette (not shown) for a 35 mm or other known film. The container 10 is defined by a two piece construction consisting of a body 12 and a cover or lid 14, which is attached to an open end 16 of the body 12 and includes a thumb tab 18 for ease in removing the cover 14 from the body 12. Many such containers exist in the field. An improved container 10, having an enhanced design of the cover 14 and cover/body interface for an elliptically shaped film cartridge is described in greater detail in copending and commonly assigned U.S. Ser. No. 08/455,957 filed concurrently herewith and which is hereby incorporated by reference. Typically, both the cover 14 and the body 12 are preferably made from the same plastic material, e.g. high density polyethylene (HDPE) and are formed using an injection molding process.

The container body 12 includes a bottom surface 20 which includes a circular recessed area 22 which is centrally inscribed within the outer periphery of the container 10 about a center axis 24. The recessed area 22 provides stability for the container 10 to stand in an upright position and also allows the container to be centered, such as for labeling, as described in greater detail below.

Included within the circular recessed area 22 of the described known container 10 is a single radial rib member 26 which extends perpendicularly from the center axis 24 along the -X'- axis of the container. The rib member 26 has a height dimension 28 which is less than or equal to that of the recessed area 22 so that the container 10 can be maintained in an upright position.

Figure 2A:
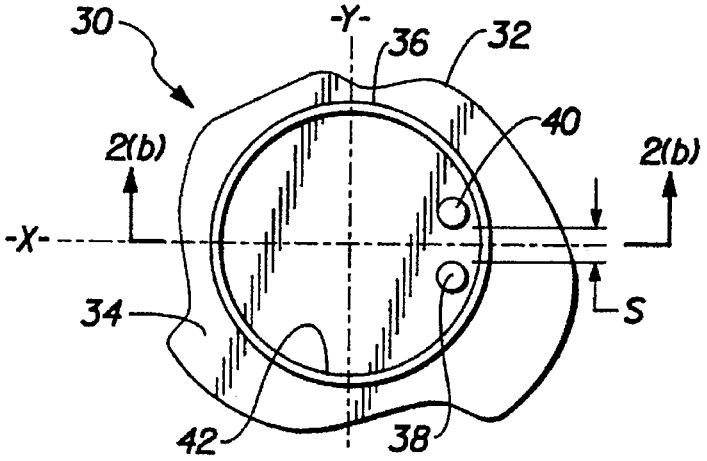
FIGS. 2(*a*) and 2(*b*) are partial top and side views of a centering apparatus used in accordance with the prior art container shown in FIGS. 1(*a*)–1(*c*)
Figure 2B:
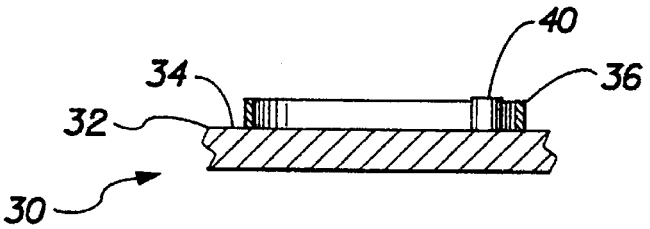

Referring now to FIGS. 2(*a*) and 2(*b*), a centering fixture 30 includes a base 32 having a circular ring 36 extending from a top surface 34. Within the periphery of the circular ring 36 are a pair of radial stops 38, 40 adjacent an inner radial surface 42 of the ring 36. The radial stops 38, 40 according to this embodiment are a pair of circular posts which are preferably spaced apart a distance S equal to the maximum toleranced distance of the radial drive rib 26 and extend from the top surface 34 a distance approximately equal to height dimension 28. In addition, the radial stops 38, 40 are equally spaced on either side of the -X'- axis of the fixture. The circular ring 36 has a fixed outer diameter which is smaller than the diameter of the recessed area 22 of a container 10 to allow placement over the ring.

To center a known container 10, the recessed area 22 of the bottom surface 20 is placed over the centering ring 36 of the centering fixture 30 such that the drive rib member 26 is positioned between the two radial stops 38, 40. The container 10 is then rotated about the center axis 24 until the rib member 26 contacts one of the radial stops 38, 40. For clarity, and according to the conventions depicted by the FIGS., the container 10 is always rotated for centering in the clockwise direction. This placement effectively centers the container 10 and allows a labeling operation to proceed, but is encumbered by dimensional variances of the known container 10, as described in the following example.

EXAMPLE

The following example illustrates the dimensional anomalies associated with the centering of a known container 10.

Referring to FIGS. 1(*a*)–1(*c*), the recessed area 22 at the bottom of the known container 10 is provided with a diameter of about 0.721 inches (1.83 cm) with a manufacturing tolerance of about +/–0.008 inches (0.20 mm). This tolerance is typical for injection molded parts such as those described. The radial drive rib member 26 has a -X'- length measured from the center axis 24 of the container 10 of about 0.295 inches (7.5 mm) and a width of 0.040 inches (1 mm) with a +/–0.005 inch (0.25 mm) manufacturing tolerance on either side, which is also a typical part tolerance, shown as t1 in FIG. 1(*c*). The drive rib member 26 has a width range W, FIG. 1(*c*), of 0.030 to 0.050 inches (0.76 to 1.27 mm).

Referring to FIGS. 2(*a*) and 2(*b*), the centering ring 36 of the centering fixture 30 has a fixed diameter of 0.710 inches (1.80 cm), and the spacing between the radial stops 38, 40 is also fixed at 0.050 inches (1.27 mm) which is equal to the maximum possible width of the radial rib member 26.

The manufacturing tolerances of the container 10 create a range of center offsets when a container 10 is positioned on the fixture 30. For example, and referring to FIG. 3(*a*), it can be shown that a container made with a maximum sized recessed diameter of 0.729 inches (1.85 mm) can offset the -X'- axis of the container 10 from the -X- axis of the fixture 30 by 0.009 inches (0.23 mm).

Figure 3A:
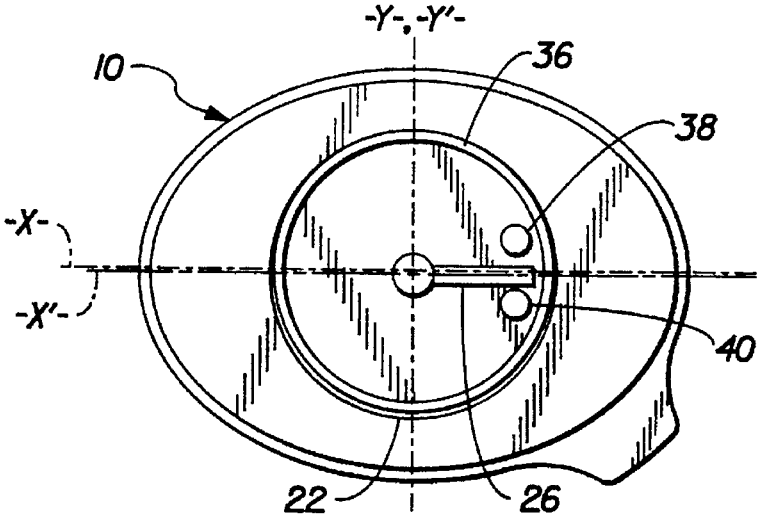
FIGS. 3(*a*), 3(*b*) and 3(*c*) are partial end views of the container of FIGS. 1(*a*)–1(*c*) as centered using the centering apparatus of FIGS. 2(*a*) and 2(*b*)
Figure 3B:
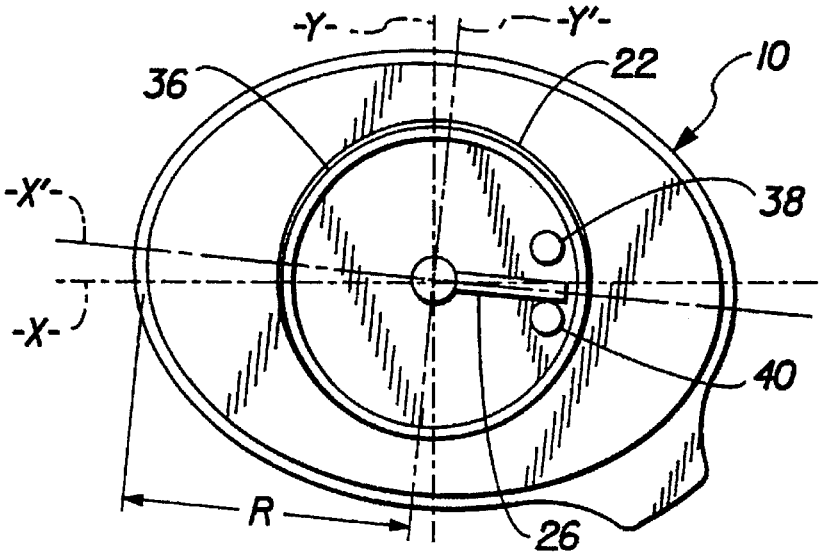
Figure 3C:
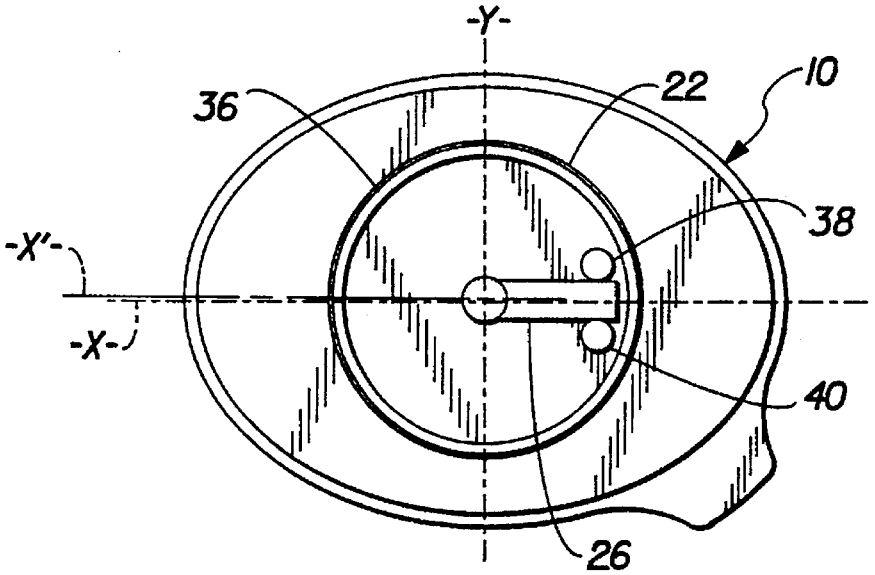

Turning to FIG. 3(*b*), an undersized radial drive rib member 26; that is, a rib member which as a result of injection molding is made to the smaller end of the tolerance range, (in this case, 0.030 inches or 0.015 inches per side) is positioned between the radial stops 38, 40. Because the spacing between the radial stops is fixed at 0.050 inches (1.27 mm), there is a dimensional disparity of about 0.020 inches (0.51 mm). In order to provide registration for the undersized radial rib member 26, the rib member 26 is rotated clockwise about the container center axis 24 until a surface of the rib member contacts against the radial stop 40.

As noted, and still referring to FIG. 3(*b*), the recessed area 22 has a smaller diameter than the diameter of the centering ring 36. Therefore, when the container 10 is rotated about its center axis 24, the container is free to pivot due to the oversized diameter of the recessed area 22.

The container 10 is preferably arranged so that the major axis of the elliptical cross section is aligned substantially with the -X- axis. In this example, the major radius (R) of the ellipse is equal to 0.695 inches (1.76 cm) creating a clockwise radial offset between the -X- and -X'- axes of the fixture and container respectively, of about 4 degrees. This radial offset translates linearly to 0.058 inches (0.15 mm), measured in the -Y- direction.

Referring now to FIG. 3(*c*), a minimum offset can be calculated when using a container 10 having a recessed area diameter of 0.713 inches (1.81 cm) and a radial rib member 26 having a maximum width of 0.050 inches (1.27 mm). In this case, there is no component of offset produced by the manufacturing tolerance mismatch between the spacing of the radial stops 38, 40 and the width of the radial rib member 26, since both are equally spaced at 0.050 inches (1.27 mm). However, the tolerance mismatch between the diameters of the centering ring 36 and the recessed area 22, respectively, still produces an offset of 0 degrees, 15 minutes in the clockwise direction. Over the major radius distance of 0.695 inches, an offset of 0.005 inches (0.13 mm) is still realized. A total range of center offset is therefore equal to:

0.058 inches–0.005 inches=0.053 inches (1.35 mm) since both offsets are in the clockwise direction, or an angular offset range of 3 degrees, 45 minutes.

Figure 4A:
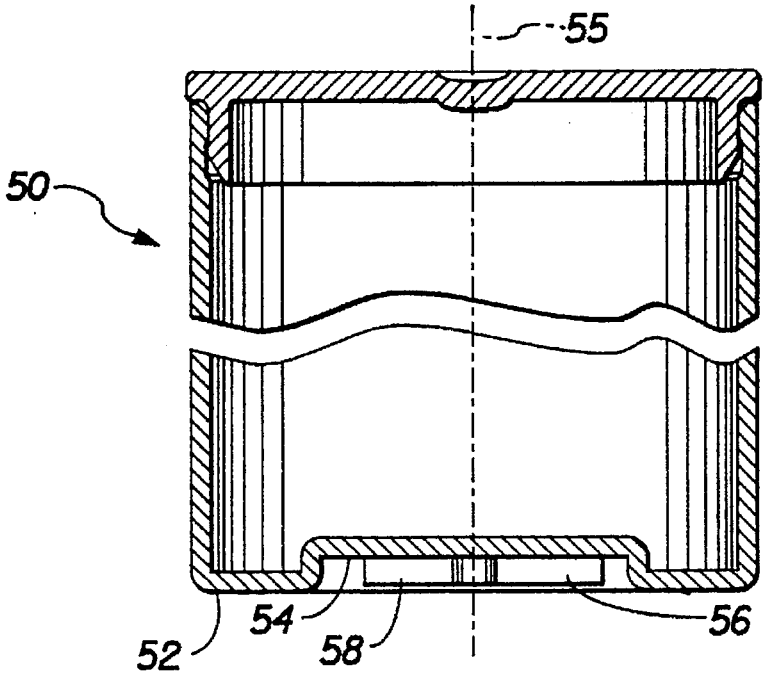
FIGS. 4(*a*) and 4(*b*) are partial side and bottom views of a container in accordance with a preferred embodiment of the present invention.
Figure 4B:
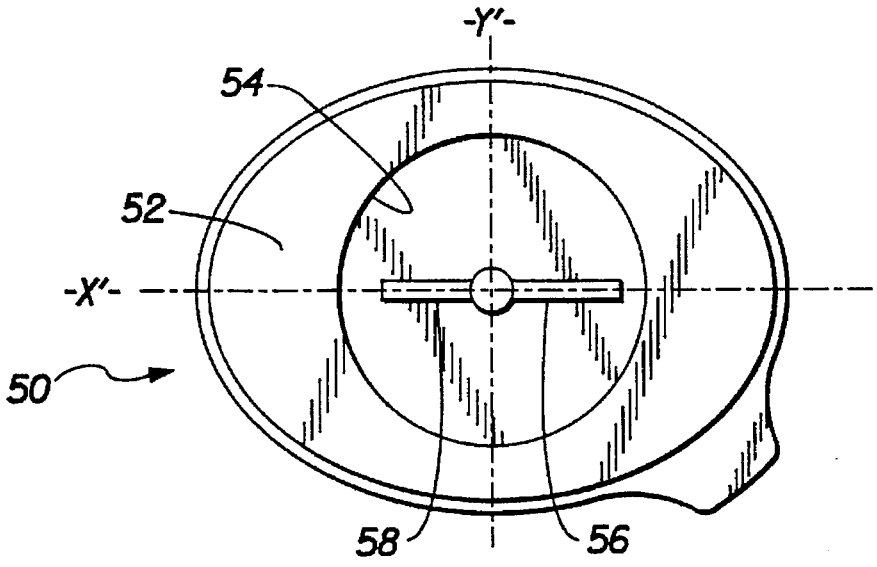

Leaving the above example for a moment, and referring now to FIGS. 4(*a*) and 4(*b*), a container 50 according to a preferred embodiment of the present invention can herein be described. The container 50 has a body and a cover, each also having an elliptical cross section similar to those previously described by the container 10. A bottom surface 52 includes a recessed area 54 which defines a recess centrally inscribed in the bottom surface 52. The recessed area 54 includes a pair of radially extending rib members 56, 58 which are diametrically opposed to one another relative to a center axis 55.

Preferably, and according to this embodiment, the radially extending rib members 56, 58 have different lengths. In this embodiment, the rib member 58 is radially shorter than rib member 56 in order to provide a specific and definite registration for the film cartridge (not shown) to be placed in the container 50, as well as providing a starting position for separate labeling or other processes. For example, orientation of the container 50 in a centering fixture 60 can be done in order to allow the cartridge (not shown) to be placed in the container in a very specific angular position.

Figure 5A:
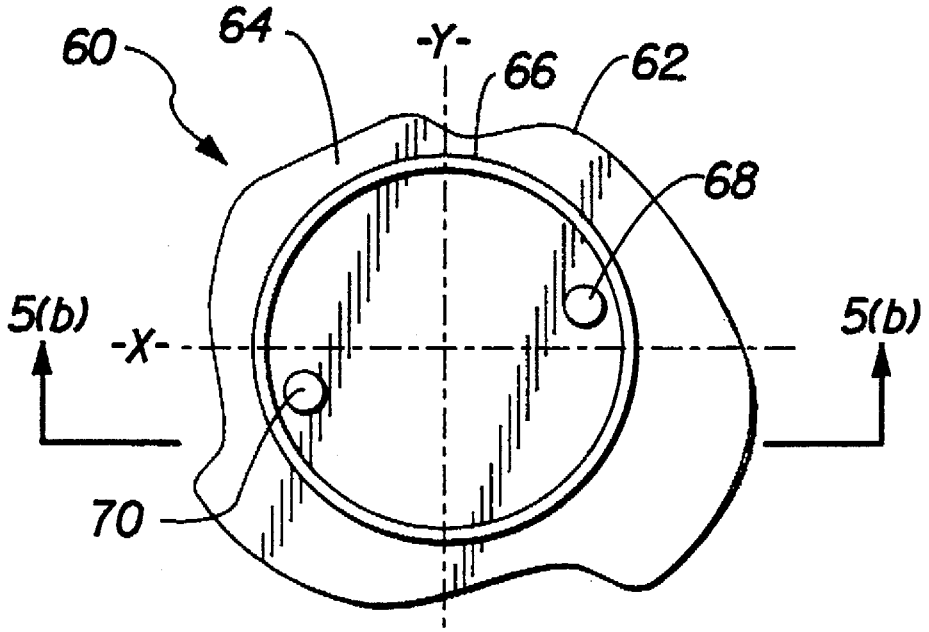
FIGS. 5(*a*) and 5(*b*) are partial top and cross sectional views respectively of a centering fixture used in accordance with the container shown in FIGS. 4(*a*) and 4(*b*)
Figure 5B:
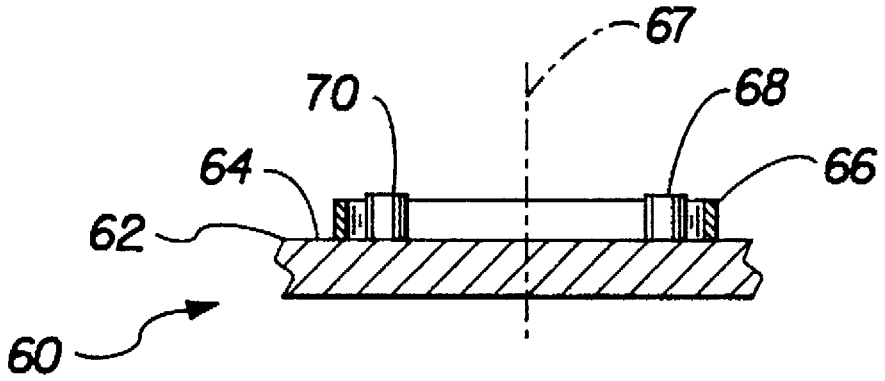

Referring to FIGS. 5(*a*) and 5(*b*), a centering fixture 60 is shown corresponding to the described container 50. The fixture 60 comprises a base 62 having a top surface 64 including a centering ring 66 depending therefrom and having substantially the same dimensions as the centering ring 36, in order to fit the centered recessed area 54 of a container 50.

Within the periphery of the centering ring 66, a pair of radial stops 68, 70 extend from the top surface 64 of the base 62 of the fixture 60 for contacting the rib members 56, 58 of the container bottom. The radial stops 68, 70 are diametrically opposed to one another relative to the center axis 67 of the fixture 60 and are spaced from one another as measured from the -X- axis, each of the radial stops being equally spaced from the -X- axis of the fixture 60.

Figure 6A:
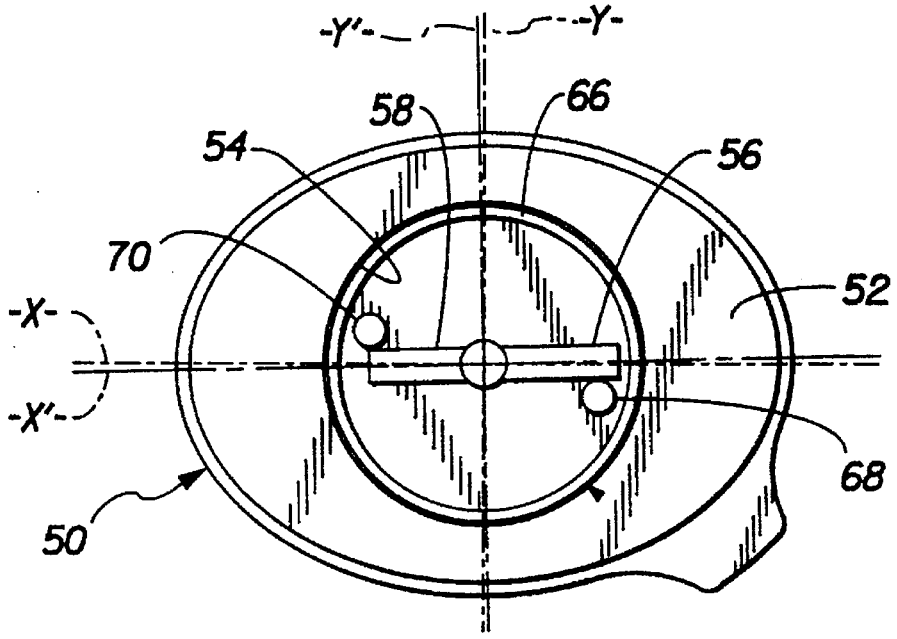
FIGS. 6(*a*) and 6(*b*) are partial end views showing the centering of the container of FIGS. 4(*a*)–4(*b*) in the centering fixture of FIGS. 5(*a*) and 5(*b*).
Figure 6B:
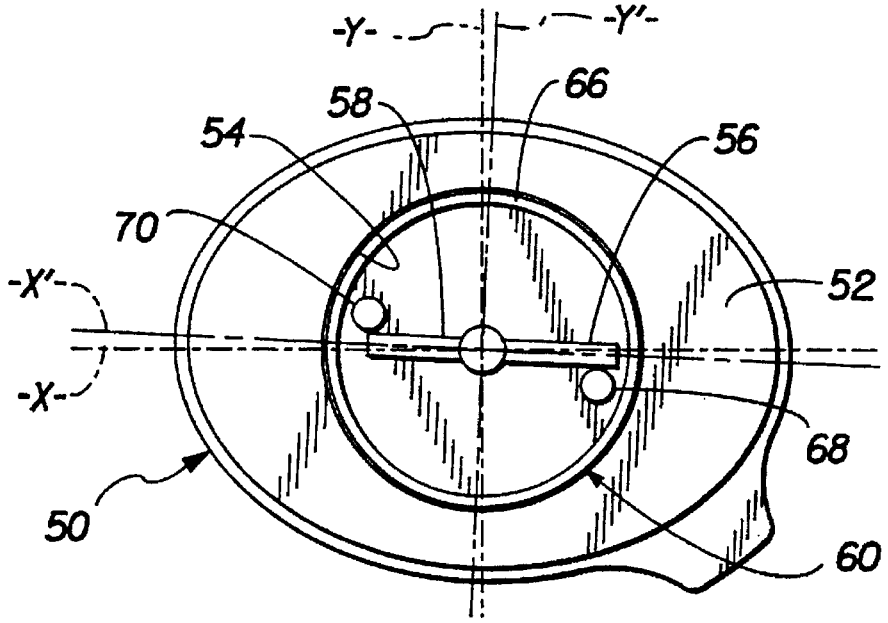

Referring to FIGS. 6(*a*) and 6(*b*), and when positioned on the centering fixture 60, the container 50, having an elliptical cross section, according to this embodiment, is arranged so that the radial rib members 56, 58 are nominally placed between the radial stops 68, 70, aligning the container 50 in a preferred manner. The container 50 is then preloaded, as previously described by rotating the container about its center axis 55, FIG. 4(*a*), in a clockwise manner, until a surface of the drive rib member 58 is brought into contact with a portion of the radial stop 70.

The provision of diametrically opposing radial rib members 56, 58 on the bottom of the container 50 as described, and a centering fixture 60 having stops 68, 70, negates the tolerance buildup between the centering ring 66 and the periphery of the recessed area 54. As the container 50 is rotated in the centering fixture 60, the vertical (-Y-) component induced by rotation due to the oversizing of the recessed area 54 is restricted by the contact between the rib members and the radial stops 68, 70. Therefore, the only play other than the tolerance buildup between the width of the rib members and the spacing between the radial stops 68, 70 between the recessed area 54 and the centering ring 66 is a horizontal component (as shown in this embodiment for clarity), which does not affect alignment.

Referring specifically now to FIG. 6(*a*), the bottom surface 52 of a container 50 is placed onto the base 62, FIG. 5(*a*) of the centering fixture 60 and the recessed area 54 is positioned over the centering ring 66. The rib members 56, 58 are oriented between the pair of radial stops 68, 70. According to this embodiment, the shorter rib member 58 is placed adjacent the radial stop 70 although either of the rib members 56, 58 can be so placed. In this case, the nominal distance between the radial stops 68, 70 is 0.040 inches (1.02 mm). A pair of rib members 56, 58, having a total maximum tolerance buildup of 0.010 inches (0.254 mm) produces an overall width of 0.050 inches (1.27 mm) which when placed in the centering fixture 60 would be offset radially by about 1 degree, 15 minutes in the counterclockwise direction, due to the oversize of the drive rib member 58 relative to the spacing of 0.040 inches (1.02 mm) between the pair of radial stops 68, 70.

Similarly, a container 50 having a pair of radial drive rib members 56, 58, each having a minimum tolerance buildup of −0.010 inches [and therefore, having an overall width of 0.030 inches (0.76 mm)] when rotated in a clockwise direction to establish registration with the radial stop 70 would be offset radially by 1 degree, 15 minutes in a clockwise direction. This angular offset is equivalent to about 0.015 inches over the span of 0.695 inches (1.77 cm).

The total range of center offset using the described twin radial drive rib design is equal to the sum of the two offsets of FIGS. 6(*a*) and 6(*b*), or about 2 degrees and 30 minutes [1 degree 15 minutes×(2)], or 0.030 inches (0.76 mm).

A 43 percent reduction (0.053−0.030) or 0.023 inches (0.58 mm) is realized using the twin or multiple drive rib design versus the known container design using a single rib member.

PARTS LIST FOR FIGS. 1–6(*b*)

10 container
12 body
14 cover
16 open end
18 thumb tab
20 bottom surface
22 recessed area
24 center axis
26 radial rib member
28 height dimension
30 centering fixture
32 base
34 top surface
36 centering ring
38 radial stop
40 radial stop
42 inner radial surface
50 container
52 bottom surface
54 recessed area
55 center axis of container
56 rib member
58 rib member
60 centering fixture
62 base
64 top surface
66 centering ring
67 center axis of fixture
68 radial stop
70 radial stop
S spacing
W width
$t_1$ tolerance The invention has been described with reference to a preferred embodiment. However, it will be appreciated that variations and modifications can be effected by a person of ordinary skill in the art without departing from the scope of the invention. For example, it should be readily apparent that containers having cross sections other than elliptical can be used; that is, either round or non-round geometry's can be utilized.

In addition, it should also be readily apparent that the design described herein should not be so limited to containers having only twin drive rib members. Additional rib members having various shapes and sizes can easily be added to provide other configurations which limit the amount of center offset.

We claim:

1. A centering combination comprising a cylindrical container having a bottom surface having at least two angular positioning members diametrically opposed to one another relative to a center axis of said container, and a centering device having a base for engaging said bottom surface and having at least two stop elements for engaging each of said diametrically opposed angular positioning members when said container is engaged with said device to restrict non-axial movement of said container when said container is being centered in said centering device.

2. A combination as recited in claim 1, wherein said container includes two diametrically opposed angular positioning elements relative to said center axis and said centering device includes two diametrically opposed stop elements for engaging said angular positioning elements for centering said container in a specific rotational orientation when said container is mounted to said centering device.

3. A combination as recited in claim 2, wherein one of said angular positioning elements has a radial length which is shorter than the other said element to provide a specific orientation for said container when said container is mounted to said device.

4. A combination as recited in claim 3, wherein said container has an elliptical cross-section.

5. A combination as recited in claim 4, wherein said container includes a circularly shaped recess along said bottom surface for engaging said centering device, said device having a circular ring having a diameter which is smaller than the diameter of said recess to allow said container to fit onto said device.

6. A cylindrical container for a film cassette, said container comprising: a body having a bottom surface and a center axis, said bottom surface including a centrally disposed recessed area defining a recess and at least two rib members disposed within said recess, said rib members extending radially from said center axis, said rib members being diametrically opposed to one another relative to said center axis, said rib members having varying radial lengths in order to define a preferred angular orientation of said container relative to said center axis.

7. The container of claim 6 wherein said recessed area is substantially cylindrical in shape.

8. The container of claim 7 wherein said container has an elliptical cross-section.

9. A method of centering a container, said container comprising a body having a bottom surface and defined by a center axis, said bottom surface having at least two diametrically opposed elements relative to said center axis, comprising the steps of:

positioning the bottom surface of the container onto a centering apparatus having a pair of positioning members;

rotating the container about the center axis until one of said diametrically opposed elements contacts a first stop surface of said centering apparatus preventing further rotation about said center axis; and the other of said diametrically opposed elements contacts a second stop surface to restrict out of alignment motion of said container relative to said centering apparatus.

* * * * *